US009060579B2

(12) United States Patent
Treska

(10) Patent No.: US 9,060,579 B2
(45) Date of Patent: Jun. 23, 2015

(54) CARRYING CASE FOR A MOBILE ELECTRONIC DEVICE

(71) Applicant: JJAB DESIGNS LLC, Newport Coast, CA (US)

(72) Inventor: Angela Treska, Newport Coast, CA (US)

(73) Assignee: JJAB DESIGNS LLC, Newport Coast, CA (US)

( * ) Notice: Subject to any disclaimer, the term of this patent is extended or adjusted under 35 U.S.C. 154(b) by 111 days.

(21) Appl. No.: 13/838,430

(22) Filed: Mar. 15, 2013

(65) Prior Publication Data

US 2014/0263494 A1 Sep. 18, 2014

(51) Int. Cl.
*A45F 5/02* (2006.01)
*A45C 11/00* (2006.01)

(52) U.S. Cl.
CPC ..... *A45C 11/00* (2013.01); *Y10S 224/93* (2013.01); *A45F 5/02* (2013.01); *A45C 2011/002* (2013.01); *A45F 2200/0516* (2013.01)

(58) Field of Classification Search
USPC ..... 224/191, 196, 197, 199, 660, 665, 666, 224/669, 676, 677, 680, 269, 930; D3/218; 24/3.11, 3.12
See application file for complete search history.

(56) References Cited

U.S. PATENT DOCUMENTS

| | | | | |
|---|---|---|---|---|
| D329,750 | S * | 9/1992 | Gilmore et al. | D3/218 |
| 5,302,302 | A * | 4/1994 | Shelley et al. | 224/148.4 |
| 6,427,293 | B1 * | 8/2002 | Bowes, Jr. | 24/304 |
| 6,478,205 | B1 * | 11/2002 | Fujihashi | 224/675 |
| 6,575,343 | B2 * | 6/2003 | Mossman | 224/198 |
| 6,742,685 | B2 * | 6/2004 | Williams | 224/197 |
| D495,872 | S | 9/2004 | Patton | |
| D518,950 | S | 4/2006 | Condiff | |
| D521,726 | S | 5/2006 | Tarantino | |
| D551,849 | S * | 10/2007 | Hoeksema | D3/207 |
| 7,546,753 | B1 | 6/2009 | Kim | |
| 8,157,140 | B2 * | 4/2012 | Jay | 224/666 |
| D684,356 | S | 6/2013 | Pegg | |
| D691,373 | S | 10/2013 | Irvine | |
| 8,749,983 | B2 * | 6/2014 | Vandiver et al. | 361/728 |
| D724,311 | S | 3/2015 | Treska | |
| 2004/0069824 | A1 * | 4/2004 | Condiff | 224/269 |
| 2007/0235492 | A1 * | 10/2007 | Sirichai et al. | 224/930 |
| 2011/0108562 | A1 * | 5/2011 | Lyons | 220/739 |
| 2013/0098954 | A1 * | 4/2013 | Inglis | 224/148.4 |

* cited by examiner

*Primary Examiner* — Justin Larson
(74) *Attorney, Agent, or Firm* — Martin & Ferraro, LLP

(57) ABSTRACT

A carrying case assembly for a mobile electronic device such as a mobile telephone. A generally rectangular cover is sized to receive the mobile electronic device therein. A first side edge of the cover is attached parallel to a base portion of an attachment mechanism for attaching the cover to an article. The attachment mechanism further includes an arcuate upper portion, and a pivotal gate between the base portion and the arcuate upper portion. The base portion of the attachment mechanism is configured such that, when the upper arcuate portion is suspended from an article, e.g., a belt loop, purse strap or the like, the base portion and the parallel first side edge of the cover are suspended at an arcuate angle with respect to vertical, of 30 degrees to 45 degrees. This angle and the configuration of the attachment mechanism to the cover makes the mobile telephone easily removable from the cover.

18 Claims, 6 Drawing Sheets

CARRYING CASE FOR A MOBILE ELECTRONIC DEVICE

FIELD OF THE INVENTION

The present invention relates to a carrying case assembly for a mobile electronic device, and more particularly to a carrying case assembly for carrying a mobile telephone on, e.g., a belt loop, a purse strap, a backpack strap, any article of clothing, or even a separate strap worn around or about a person's body.

BACKGROUND OF THE INVENTION

Carrying cases for mobile electronic devices, e.g., mobile telephones are known. One known case configuration includes a case with a generally planar hook or similar attaching mechanism to attach the case to a wearer's belt or pant waist, with both the case and the mobile telephone positioned in a vertical or near-vertical orientation. This vertical orientation of the case and phone is disadvantageous because, when the user attempts to pull a ringing mobile phone out of the case, the case often flips outward or upward, temporarily snagging the phone inside the case, and delaying the user from answering the call. Other well-known case configurations include hooks for attaching the cases to belts, purse straps or backpacks, that are weak and break easily, resulting in possible loss of both the phone and the carrying case. Also, the hooks for well-known case configurations are loosely attached to the case itself making it difficult to remove a mobile electronic device from the case with one hand. Finally, typical mobile phone carrying cases are large enough to hold only the mobile phone, and no other desirable extra items, e.g., a credit card, cash, a form of identification, or a key.

It is accordingly a primary object of the invention to provide a carrying case for a mobile electronic device, e.g., a mobile telephone, which corrects one or more of the shortcomings of the related art.

This is achieved by a carrying case assembly for a preselected mobile electronic device, e.g., a mobile telephone, comprising the various combinations of elements set forth in the appended claims.

SUMMARY OF THE INVENTION

In accordance with the invention, a carrying case assembly carries a preselected mobile electronic device, including but not limited to a mobile telephone, on an article, e.g., a belt loop, a purse strap, a backpack accessory loop, or the like, the article defining a vertical axis. The carrying case assembly includes a generally rectangular cover having first and second side edges and a bottom edge, the side and bottom edges defining an interior with preselected dimensions corresponding to a size of the preselected mobile device or to a range of sizes for a group of mobile devices, and an opening opposite the bottom edge sized to permit the preselected mobile device to be inserted into and removed from the interior. An attachment mechanism is provided for attaching the cover to the article. The attachment mechanism includes a base portion attachable to the first side edge, configured to be substantially parallel to the first side edge when attached thereto, a generally upright portion extending upward from the base portion at a first acute angle which is defined with respect to the base portion, and extending from the base portion to an upper arcuate portion, a gate portion pivotally attached to the base portion, and pivotable between a closed position with a distal end thereof contacting a corresponding distal end of the upper arcuate portion to define, with the base portion and the upper arcuate portion, an enclosed portion, and an open position with the gate pivoted inward out of contact with the corresponding distal end of the upper arcuate portion, into the enclosed portion, and an attachment structure connected to the base portion for securely attaching the base portion to the first side edge of the cover. The upper arcuate portion of the hook is configured to engage the article, with the base portion of the attachment mechanism and the parallel first side edge of the cover positioned at a second acute angle, which is defined with respect to the vertical axis. The attachment mechanism, or hook assembly, permits the carrying case to be attached to anything the carrier desires, or be used on multiple positions around the carrier's body, such as a on a tank top, a swimsuit, a necklace, and the like.

As broadly embodied herein, the second acute angle preferably is an angle of between 30 degrees and 45 degrees, to allow for ease of inserting the mobile phone into the cover, and for ease of removing the mobile phone from the cover.

As broadly embodied herein, the cover further preferably comprises at least one aperture in the bottom portion, and at least one aperture in at least one of the side portions for pushing the phone out of the cover, for inserting a fingertip to expand the interior, and/or for inserting therethrough an electrical connector of a charging cord to charge the electronic mobile device.

As broadly embodied herein, the cover preferably further comprises a face with at least one pocket defined therein, the pocket configured to hold at least one additional item, such as a credit card, a form of identification, e.g., a driver's license, cash, or a key. It is further preferred that the at least one pocket be closable by a closing mechanism, e.g., a snap closure, hook and loop fastener, or the like.

Additional objects and advantages of embodiments of the invention will be set forth in part in the description which follows, and in part will be evident from the description, or may be learned by practice of the invention. The objects and advantages of embodiments of the invention will be realized and attained by means of the elements and combinations particularly pointed out in the appended claims.

It is to be understood that both the foregoing general description and the following detailed description are exemplary and explanatory only and are not restrictive of the invention, as claimed.

The accompanying drawings, which are incorporated in and constitute a part of this specification, illustrate the presently preferred embodiments of the invention and together with the description, serve to explain the principles of the invention.

DESCRIPTION OF THE PREFERRED EMBODIMENT

Reference will now be made in detail to a present embodiment of the invention, an example of which is illustrated in the accompanying drawings. Wherever possible, the same reference numbers will be used throughout the drawings to refer to the same or like parts.

In accordance with an embodiment of the invention, a carrying case assembly 10 is utilized for carrying a preselected mobile electronic device 12 on an article 14. The article 14 defines a vertical axis A-A'. The preselected mobile electronic device 12 may be, but is not limited to, a mobile telephone such as a smartphone or other personal communication device, a portable GPS device, or other device having similar features and portability. Other preselected mobile electronic devices, e.g., mobile electronic games also can be carried by an appropriately sized carrying case assembly, and are within the scope of the invention. As broadly embodied in FIG. 1, the article 14, on which the carrying case assembly is carried, and which defines the vertical axis A-A' is a belt loop, but could just as easily be a purse strap, a component of a backpack, a piece of worn jewelry, or the like.

Figure 1:
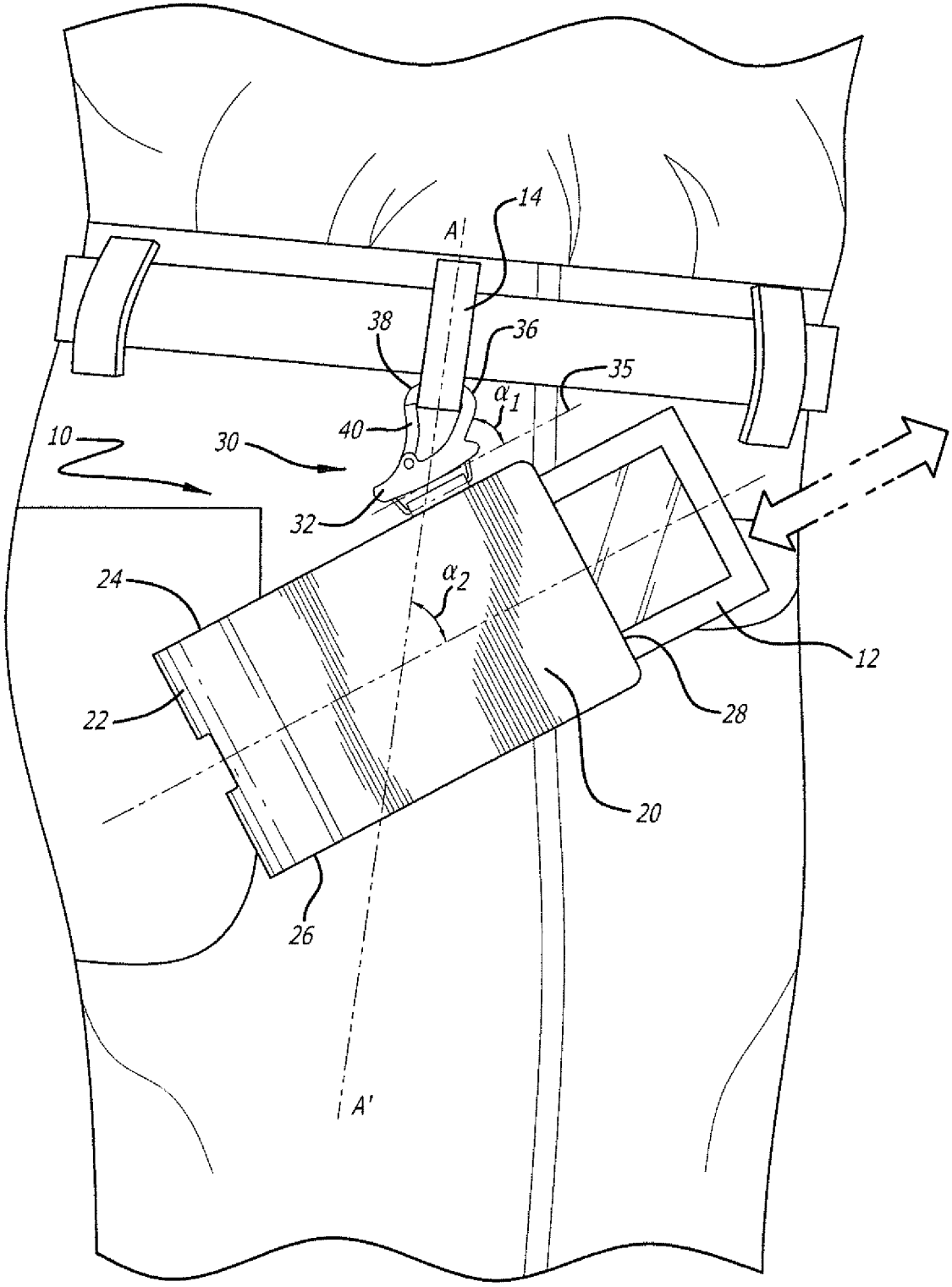
FIG. 1 is a side view of a carrying case assembly for carrying a preselected mobile electronic device, in accordance with an embodiment of the invention, attached to a user's belt loop, the belt loop defining a vertical axis, and depicting configuration of the attachment mechanism which, in accordance with an embodiment of the invention, enables the case and the preselected electronic device to be carried at the desired acute angle with respect to the vertical axis.
Figure 2:
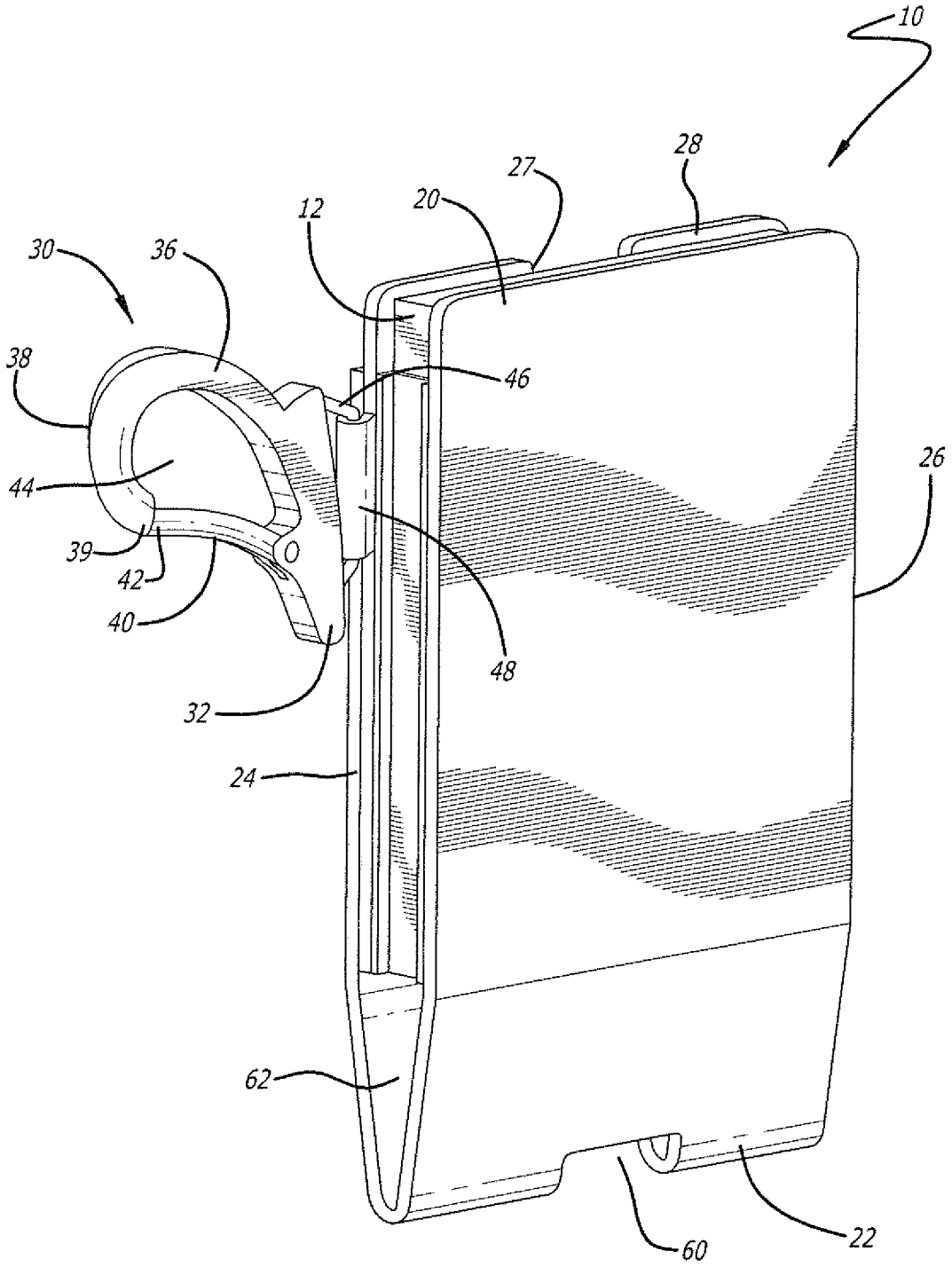
FIG. 2 is a front perspective view of the carrying case assembly for carrying a preselected mobile electronic device, in accordance with an embodiment of the invention, depicting the case and the attachment mechanism.
Figure 3:
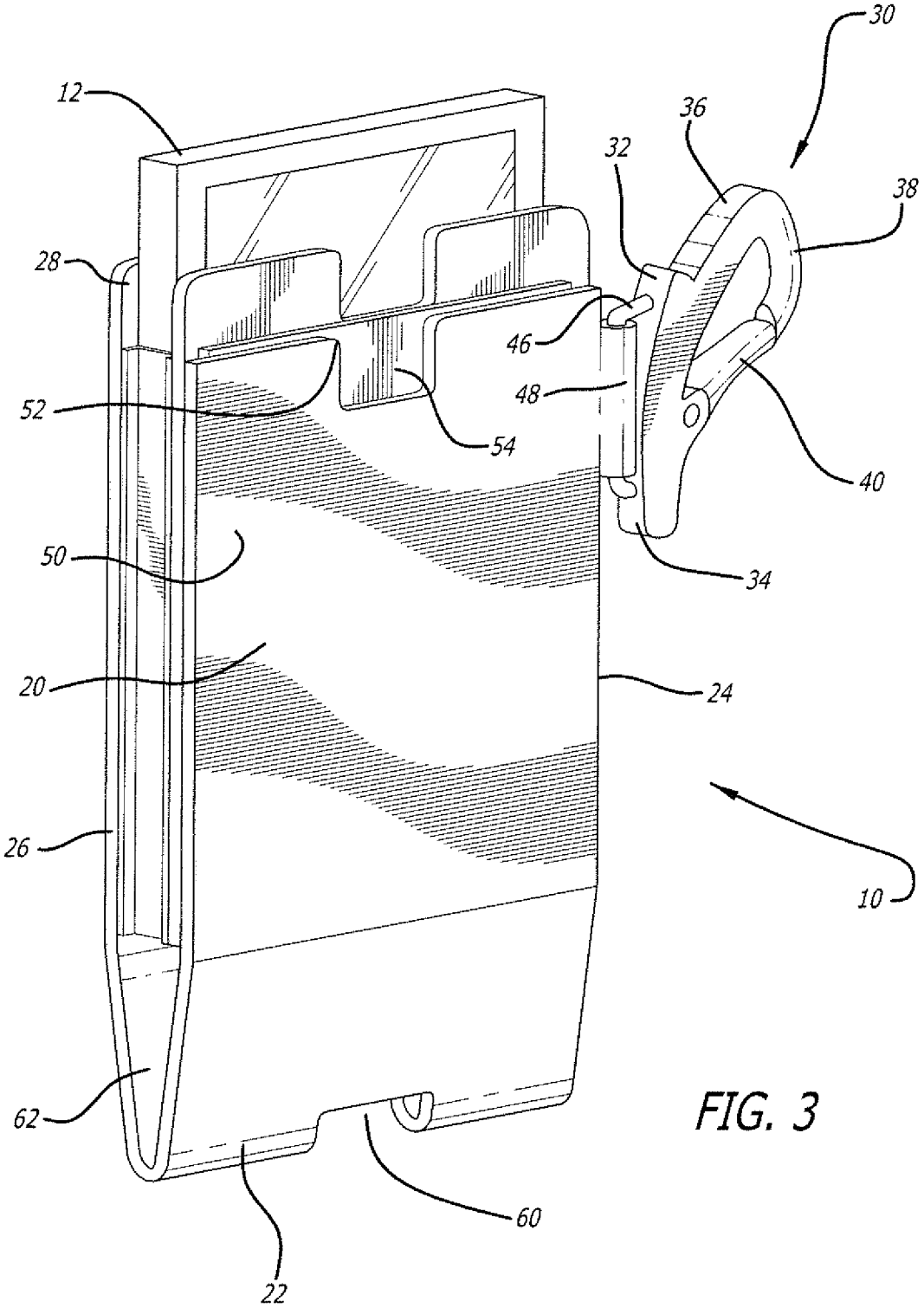
FIG. 3 is a rear perspective view of a carrying case assembly for carrying a preselected mobile electronic device, in accordance with an embodiment of the invention, depicting a case and an attachment mechanism, the preselected mobile electronic device configured to be insertable and removable from the case, and a pocket for carrying an additional item.
Figure 4:
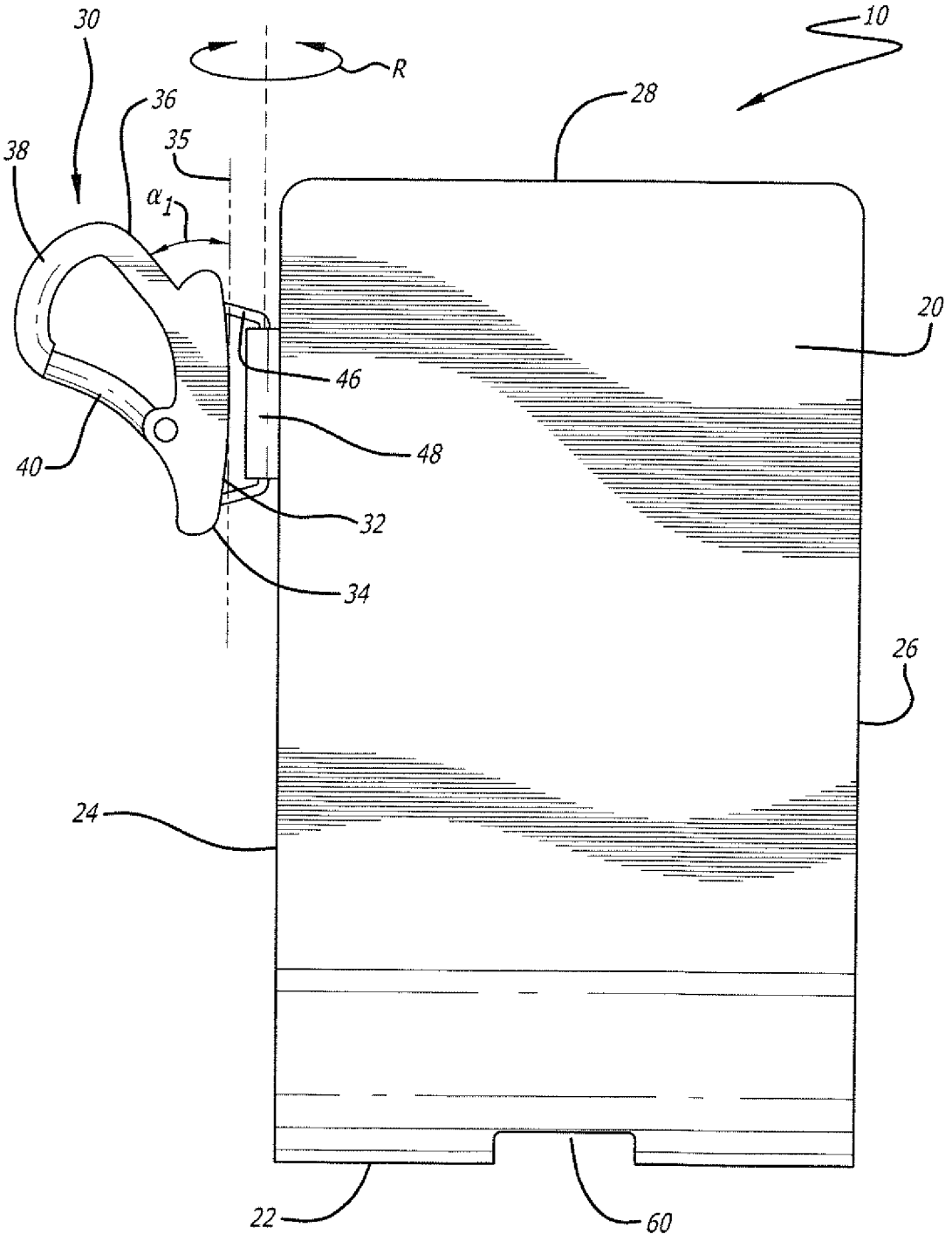
FIG. 4 is a front view of the carrying case assembly for carrying a preselected mobile electronic device, in accordance with an embodiment of the invention, depicting the case and the attachment mechanism.
Figure 5:
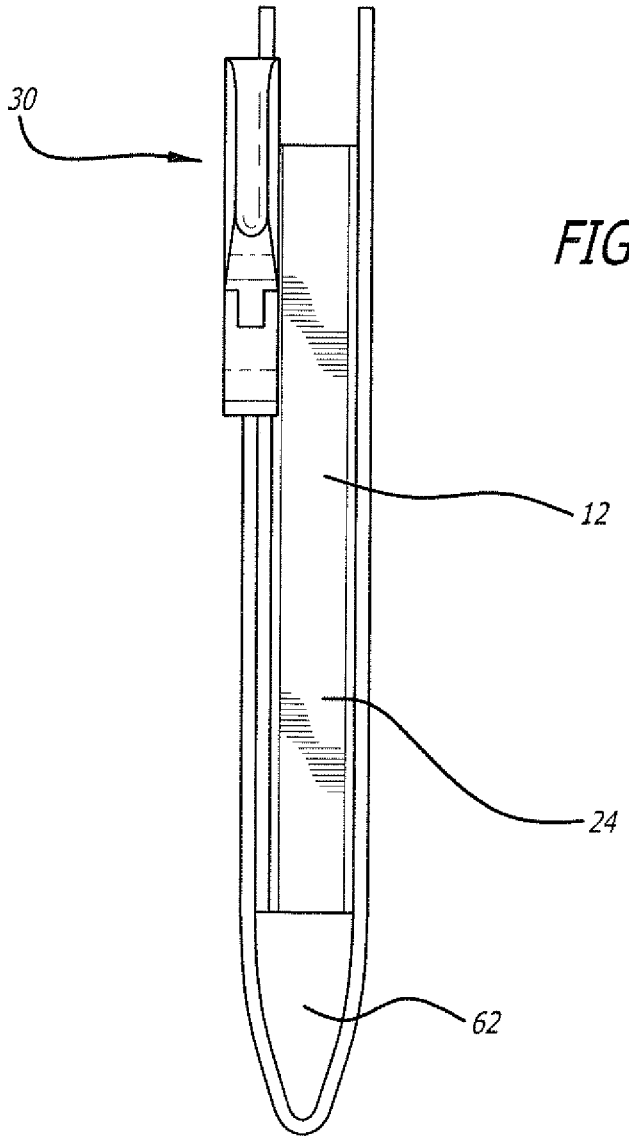
FIG. 5 is a side view of the carrying case assembly for carrying a preselected mobile electronic device, in accordance with an embodiment of the invention, depicting the case and the attachment mechanism.
Figure 7:
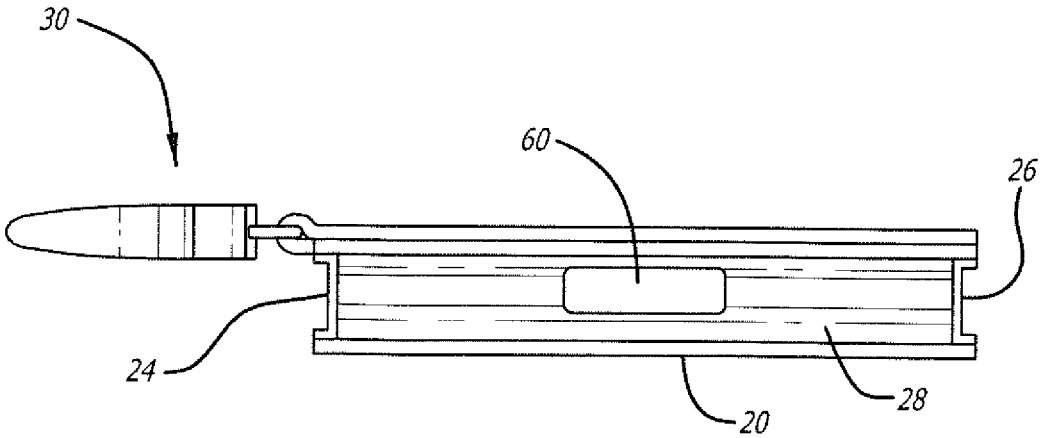
FIG. 7 is a bottom view of the carrying case assembly for carrying a preselected mobile electronic device, in accordance with an embodiment of the invention, depicting the case, the attachment mechanism, and the aperture defined in the bottom edge of the case, dimensioned to allow the user to push the mobile electronic device upward out of the case, and/or to insert an electrical connector of a charging cord.
Figure 6:
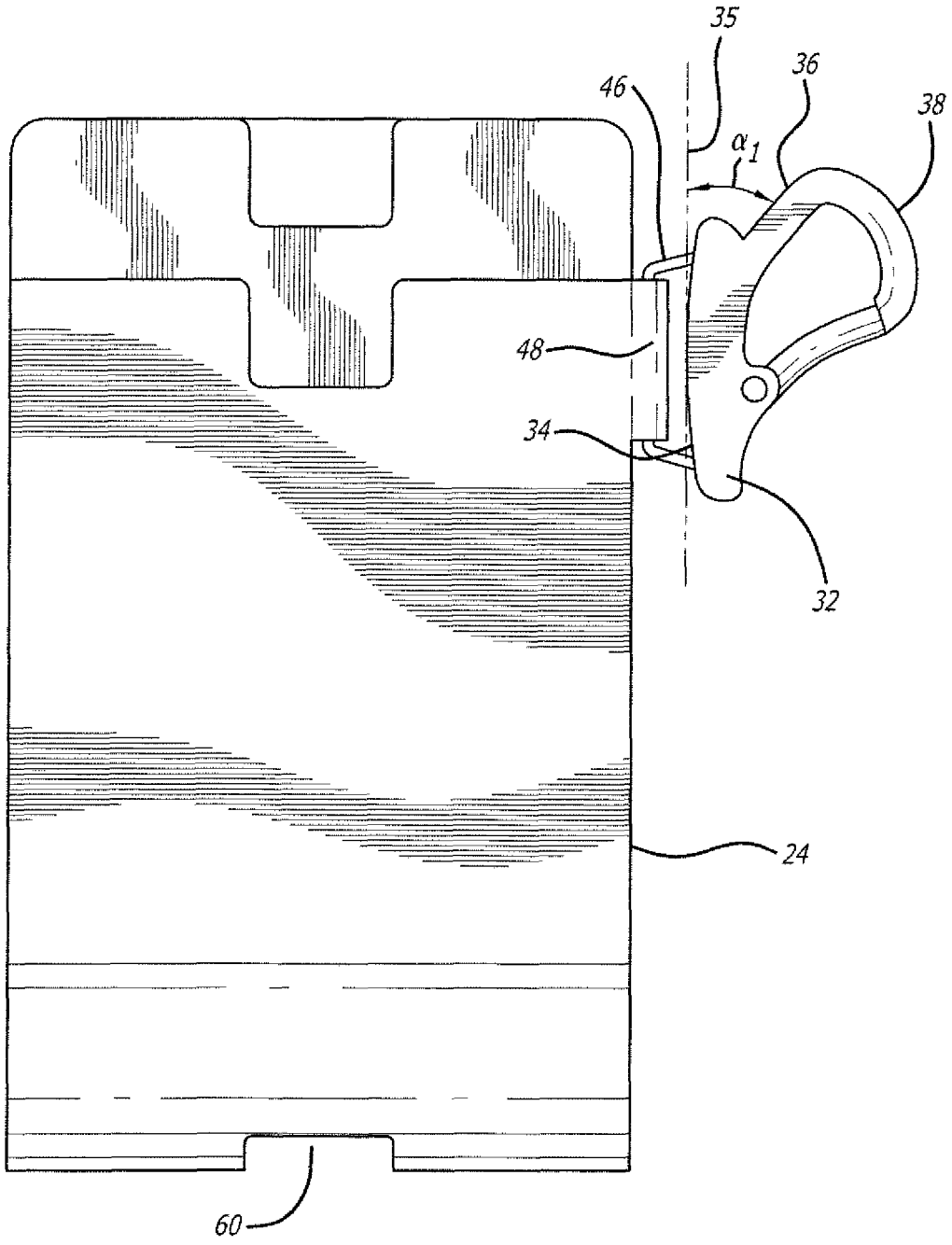
FIG. 6 is a rear view of the carrying case assembly depicted in FIG. 3 for carrying a preselected mobile electronic device, in accordance with an embodiment of the invention, depicting the case, the attachment mechanism, and an aperture defined in the bottom edge of the case, dimensioned to allow the user to push the mobile electronic device upward out of the case, and/or to insert an electrical connector of a charging cord.

In accordance with an embodiment of the invention, and as broadly embodied in FIGS. 1-3, carrying case assembly 10 includes a case or cover 20. Cover 20 preferably is made of leather or some other flexible, sturdy, fashionable material, may be decorated as desired, and is dimensioned with a preselected volume sized to permit the preselected mobile electronic device 12 to be inserted therein, and to fit the device relatively snugly, similar to a fit of a glove on a hand. The cover 20 includes a bottom edge 22, a first side edge 24, and a second side edge 26, the three edges defining an interior 27 sized to receive and hold the electronic mobile device 12 therein. The cover 20 further includes an opening 28 opposite the bottom edge 22, configured to permit mobile electronic device 12 to be inserted and removed therethrough.

In accordance with an embodiment of the invention, and as broadly embodied in FIGS. 1-7, carrying case assembly 10 includes an attachment mechanism 30 for attaching the cover 20 to the article 14. Attachment mechanism 30 includes a base portion 32. Base portion 32 includes a surface 34 defining an arc of approximately 2 degrees-3 degrees. An imaginary tangent line 35 adjacent to base portion 32, best seen in FIG. 6, in a preferred embodiment contacts a point of greatest radius of the arcuate surface 34 and is preferably substantially parallel with the first edge 24 of the cover 20. Because the arc of base surface 34 is so shallow, base surface 34 of base portion 32 is generally parallel to first edge 24, and alternatively base surface 34 may be modified according to design preferences including being flat and substantially parallel to first edge 24. FIG. 1 depicts the first side edge 24 as the right-hand side edge of the cover 20, and the apparatus 10 carried on the user's right side, but the invention is not so limited. The first side edge 24 also can be the left-hand side edge of the cover 20, and the apparatus 10 can be carried on the user's left side.

Attachment mechanism 30, as broadly embodied herein, further includes a generally upright portion 36, extending upward to an upper hooked portion 38. Upright portion 36 extends upward at a first acute angle $\alpha_1$ with respect to the tangent line 35. Preferably, the upper hooked portion 38 is configured to engage with the article 14.

The attachment mechanism 30 further includes a gate portion 40, pivotally attached to the base portion 32. Gate portion 40 is pivotable between a closed position, with a distal end 42 of the gate portion 40 in contact with a corresponding distal portion 39 of the upper hooked portion 38, thereby defining an enclosed portion 44, and an open position, with the distal end 42 of the gate portion 40 out of contact with the corresponding distal portion 39 of the upper hooked portion 38, and pivoted inward into the enclosed portion 44. When the gate portion 40 is in the open position, upper hooked portion 38 is free to be engaged with the article 14, after which the gate portion 40 is free to pivot back to the closed position.

Attachment mechanism 30 further includes a connector, i.e., at least one generally C-shaped metal loop 46 attached to a corresponding tubular loop 48 projecting from the first side edge 24 of the cover 20. The connection of the metal loop 46 and the corresponding tubular loop 48 on the cover 20 is sufficiently strong as to prevent accidental breakage, and resultant potential loss of the carrying case and mobile electronic device. Tubular loop 48 is sufficiently rigid to restrict separation movement and/or pulling away of metal loop 46 from cover 20 while permitting rotational movement of metal loop 46 about its longitudinal axis passing through the passage formed by tubular loop 48 as indicated by rotational arrow R in FIG. 4. In such embodiment, this creates a single axis of rotational freedom with respect to the cover 20 and the attachment mechanism 30. In this manner, the securing of attachment mechanism 30 to the cover 20 creates a unitary assembly that allows for both proper positioning of the carrying case assembly when worn, and also facilitates removal of the mobile electronic device 12 by limiting off-axis movement of the cover 20 with respect to the attachment mechanism 30.

In accordance with an embodiment of the invention, and as broadly embodied in FIG. 1, when the carrying case assembly 10 is carried on the article 14, the configuration of the attachment mechanism 30, particularly the parallel relationship between the base 32 and the first edge 24 of the cover 20 combined with the acute angle $\alpha_1$ between tangent line 35 and the upright portion 36, causes the carrying case assembly 10 and the mobile electronic device 12 to be suspended from the article 14 at an acute angle $\alpha_2$ with respect to the vertical axis A-A'. Acute angle $\alpha_2$ is an angle, preferably between 30 degrees and 45 degrees with respect to vertical axis A-A' but will depend on user preference and the specific article which is used to hold attachment mechanism 30. This angle is ideal for ease of inserting the mobile electronic device 12 into the cover 20, and for ease of withdrawing the mobile electronic device 12 from the cover 20. For example, when a mobile phone is ringing, it has been determined that the user can easily and successfully withdraw the phone from the cover 20, when the cover 20 is positioned at an angle $\alpha_2$ of 30 degrees to 45 degrees with respect to vertical, without the phone becoming snagged on the cover. Alternatively, an adjustment mechanism (not shown) may be incorporated into a preferred embodiment, either in the attachment mechanism 30 itself or via the connection of the attachment mechanism 30 to the cover 20, to vary the relative position of the attachment mechanism 30 to the cover 20. In such a manner, the angle $\alpha_2$ may be varied and adjusted according to the preferences of a user.

Referring to FIG. 3, it is preferred that cover 20 further have a face 50 with a pocket 52 defined therein. Pocket 52 is dimensioned to hold an extra item 54 which may be, e.g., a credit card, cash, identification such as a driver's license, a key, or the like. In addition, pocket 52 can be closeable with a closing mechanism (not shown), e.g., a snap or a hook and loop closure, or the like. Moreover, an extra pocket 52 can be provided on the same face 50, or an opposite face 50, or single pocket 52 can be configured with expandable accordion-like sides to be expanded in order to carry more than one extra item 54 on the cover 20.

It is further preferred, as broadly embodied in FIGS. 2-7, that the cover 20 be configured with one or more finger-sized apertures 60 and 62. As broadly embodied herein, a bottom edge aperture 60 is defined in the bottom edge 22. Bottom edge aperture 60 is configured large enough for a user to insert a fingertip therein in order to push the mobile electronic device 12 out of the opening 28, or alternatively to insert an electrical connector of a charging cord (not shown) to charge the device. As further broadly embodied herein, side apertures 62 can be defined in one or both of the first and second side edges 24 and 26. Preferably, side apertures 62 are configured large enough for a user to insert a fingertip therein in order to push the mobile electronic device 12 out of the opening 28, or alternatively to insert a fingertip therein to spread cover 20 open to receive the electronic mobile device 12 more easily. In addition, opening 28 can be secured or closeable with a closing mechanism (not shown), e.g., a snap or a hook and loop closure, or the like, to help prevent the mobile electronic device 12 from inadvertently slipping out of the cover 20.

Other embodiments of the invention will be apparent to those skilled in the art from consideration of the specification and practice of the invention disclosed herein. It is intended that the specification and examples be considered as exemplary only, with a true spirit and scope of the invention being indicated by the following claims and their legal equivalents.

What is claimed is:

1. A carrying case assembly for carrying a preselected mobile electronic device on an article, the carrying case assembly comprising:

a generally rectangular cover comprising first and second side edges and a bottom edge, the side and bottom edges defining an interior with a preselected volume corresponding to a size of the preselected mobile device, an opening opposite the bottom edge, sized to permit the preselected mobile electronic device to be inserted into and removed from the interior, the cover having a central longitudinal axis passing through the bottom edge and the opening opposite the bottom edge, and a tubular loop projecting from the first side edge having a passage therethrough with a central longitudinal axis generally parallel to the central longitudinal axis of the cover; and an attachment mechanism for attaching the cover to the article, the attachment mechanism comprising:

a base portion attachable to the cover, and configured to be substantially parallel to the first side edge when attached to the cover;

a generally upright portion extending upward at a first acute angle defined with respect to the base portion, and extending from the base portion to an upper arcuate portion;

a gate portion pivotally attached to the base portion, and pivotable between a closed position with a distal end thereof contacting a corresponding distal end of the upper arcuate portion to define an enclosed portion with the base portion and the upper arcuate portion, and an open position with the gate pivoted inward out of contact with the corresponding distal end of the upper arcuate portion, into the enclosed portion; and a connector rigidly attached to the base portion and configured to be inserted at least in part within the passage of the tubular loop portion of the cover to pivotally connect the base portion to the first side edge of the cover;

wherein the upper arcuate portion is configured for attachment to the article with the base portion of the attachment mechanism and the first side edge of the cover positioned at a second acute angle, defined between the central longitudinal axis of the cover and a central longitudinal vertical axis passing through both the upper arcuate portion and the base portion of the attachment mechanism.

2. The carrying case assembly of claim 1, wherein an aperture is defined in at least one of the bottom edge the first side edge and the second side edge of the cover.

3. The carrying case assembly of claim 1, wherein the second acute angle is between approximately 30 degrees and 45 degrees.

4. The carrying case assembly of claim 1, wherein the cover further comprises a face with at least one pocket defined therein.

5. The carrying case assembly of claim 4, wherein the pocket is closable with a closure mechanism attached thereto.

6. The carrying case assembly of claim 1, wherein the base portion defines an arc, a tangent line contacting the arc is parallel to the central longitudinal axis of the cover, and the tangent line and the first side edge define the second acute angle with respect to the central longitudinal vertical axis.

7. The carrying case assembly of claim 2, wherein the at least one aperture is dimensioned to receive therethrough an electrical connector of a charging cord.

8. The carrying case assembly of claim 1, wherein the second acute angle is a constant angle when the upper arcuate portion is attached to the article.

9. The carrying case assembly of claim 1, wherein the attachment mechanism is attachable or removable from the article by pivoting the gate portion with respect to the upper arcuate portion.

10. The carrying case assembly of claim 1, wherein the mobile electronic device is a mobile telephone.

11. A method of carrying a preselected mobile electronic device on an article, the method comprising:

utilizing a generally rectangular cover comprising first and second edges and a bottom edge, the side and bottom edges defining an interior with a preselected volume corresponding to a size of the preselected mobile electronic device, an opening opposite the bottom edge, sized to permit the preselected mobile electronic device to be inserted into and removed from the interior, the cover having a central longitudinal axis passing through the bottom edge and the opening opposite the bottom edge, and a tubular loop projecting from the first side edge having a passage therethrough with a central longitudinal axis generally parallel to the central longitudinal axis of the cover;

utilizing an attachment mechanism for attaching the cover to the article, the attachment mechanism comprising a base portion attachable to the cover, and configured to be parallel to the first side edge when attached to the cover, a generally upright portion extending upward at a first acute angle defined with respect to the base portion, extending from the base portion to an upper arcuate portion, a gate portion pivotally attached to the base portion, and pivotable between a closed position with a distal end thereof contacting a corresponding distal end of the upper arcuate portion to define, with the base portion and the upper arcuate portion an enclosed portion, and an open position with the gate pivoted inward out of contact with the distal end of the upper arcuate portion, into the enclosed portion, and a connector rigidly attached to the base portion and configured to be inserted at least in part within the passage of the tubular loop portion of the cover to pivotally connect the base portion to the first side edge of the cover;

attaching the upper arcuate portion to the article with the base portion of the attachment mechanism and the first side edge of the cover positioned at a second acute angle, defined between the central longitudinal axis of the cover and a central longitudinal vertical axis passing through both the upper arcuate portion and the base portion of the attachment mechanism; and inserting the preselected mobile device though the opening into the interior of the cover.

12. The method of claim 11, further comprising pushing the preselected electronic mobile device via apertures in at least one of the bottom edge and the side edges out of the opening in order to remove the device from the cover.

13. The method of claim 11, wherein inserting the preselected electronic mobile device into the cover, and removing the device from the cover comprises inserting and removing a mobile telephone.

14. The method of claim 11, wherein attaching the upper arcuate portion to the article comprises pivoting the gate portion to the open position, attaching the upper arcuate portion to the article, and pivoting the gate portion to the closed position.

15. The method of claim 11, further comprising expanding the interior of the cover via inserting an object via one or more apertures defined in one or more sides of the cover.

16. The method of claim 11, further comprising carrying an additional item in a pocket defined in a face of the cover.

17. A device carrying case configured to be worn on an article of clothing, comprising:

a cover defining an opening allowing for insertion and removal of the device within an interior portion of the cover, the cover having a central longitudinal axis passing through a bottom edge of the cover and the opening opposite the bottom edge, and a tubular loop projecting from a side edge of the cover having a passage therethrough with a central longitudinal axis generally parallel to the central longitudinal axis of the cover;

an attachment mechanism having a hooked portion for securing the carrying case to the article of clothing, the attachment mechanism further comprising:

a base portion attached to the cover, the base portion having a connector rigidly attached to the base portion and configured to be inserted at least in part within the passage of the tubular loop portion of the cover limiting movement of the attachment mechanism about only a rotational axis parallel to the side edge of the cover;

wherein the hooked portion extends from the base portion at a first angle relative to the side edge of the cover such that the carrying case is positioned at a second angle defined between the central longitudinal axis of the cover and a central longitudinal vertical axis passing through both the hooked portion and the base portion of the attachment mechanism when worn on the article.

18. The device carrying case of claim 17, wherein the second angle is between approximately 30 and 45 degrees.

* * * * *

UNITED STATES PATENT AND TRADEMARK OFFICE

CERTIFICATE OF CORRECTION

PATENT NO. : 9,060,579 B2
APPLICATION NO. : 13/838430
DATED : June 23, 2015
INVENTOR(S) : Angela Treska It is certified that error appears in the above-identified patent and that said Letters Patent is hereby corrected as shown below:

In the Claims:

Column 7, Claim 11:

Line 34: change "though" to -- through --.

Signed and Sealed this
Twenty-seventh Day of October, 2015

Michelle K. Lee

Michelle K. Lee
*Director of the United States Patent and Trademark Office*